US005649648A

United States Patent [19]

Lier et al.

[11] Patent Number: 5,649,648

[45] Date of Patent: Jul. 22, 1997

[54] PACKAGE FOR FREE-FLOWING PRODUCTS

[75] Inventors: Rolf Lier, Neustadt; Herbert Densky, Barsinghausen, both of Germany

[73] Assignee: Henkel Kommanditgesellschaft auf Aktien, Duesseldorf, Germany

[21] Appl. No.: 397,074

[22] PCT Filed: Aug. 28, 1993

[86] PCT No.: PCT/EP93/02333

§ 371 Date: Mar. 6, 1995

§ 102(e) Date: Mar. 6, 1995

[87] PCT Pub. No.: WO94/05586

PCT Pub. Date: Mar. 17, 1994

[30] Foreign Application Priority Data

Sep. 5, 1992 [DE] Germany ..... 42 29 734.6

[51] Int. Cl.[6] ..... B65D 37/00

[52] U.S. Cl. ..... 222/206; 222/212; 222/482

[58] Field of Search ..... 222/206, 212, 222/213, 482

[56] References Cited

U.S. PATENT DOCUMENTS

| | | | |
|---|---|---|---|
| 47,896 | 5/1865 | Hart | 222/206 |
| 300,450 | 7/1884 | Doremus | 222/213 |
| 444,301 | 1/1891 | Myers | 222/213 |
| 509,309 | 11/1893 | Hauck, Jr. | 222/212 |
| 523,254 | 7/1894 | Winkley | 222/213 |
| 936,186 | 10/1909 | Telllerson | 222/213 |
| 1,188,067 | 6/1916 | Greer | 222/212 |
| 2,050,246 | 8/1936 | Colvin | 222/206 |
| 2,432,288 | 12/1947 | Danziger | 222/206 X |
| 3,035,742 | 5/1962 | Cholet | 222/213 |
| 4,787,536 | 11/1988 | Widerstrom | 222/212 |
| 4,917,267 | 4/1990 | Laverdure | 222/7 |

FOREIGN PATENT DOCUMENTS

| | | | |
|---|---|---|---|
| 124098 | 5/1947 | Austria | 222/206 |
| 0061522 | 10/1982 | European Pat. Off. . | |
| 2639952 | 3/1978 | Germany . | |
| 521815 | 5/1940 | United Kingdom | 222/206 |

*Primary Examiner*—Andres Kashnikow
*Assistant Examiner*—Kenneth Bomberg
*Attorney, Agent, or Firm*—Ernest G. Szoke; Wayne C. Jaeschke; Kenneth Watov

[57] ABSTRACT

A package for free-flowing products comprising a product container and a closable applicator point fitted on its outlet aperture provides precise metering of the quantity of product expelled regardless of the level in the package, and while ensuring easy handling. The product container consists of an extruded receptacle of aluminum having externally depressible walls which spring back when the pressure is released.

18 Claims, 1 Drawing Sheet

PACKAGE FOR FREE-FLOWING PRODUCTS

BACKGROUND 1.0 Field of the Invention

This invention relates to a package for fluid products comprising a container for holding the product, and a closeable dispensing nozzle attached to the outlet opening of the product container.

2.0 Discussion of Related Art

Packages of the type in question, more particularly for fluid adhesives, are typically provided by plastic bottles. To remove product, the user applies external pressure to the walls of the flexible plastic bottle so that adhesive flows out through the opened dispensing nozzle. Although this known package is suitable for many applications, it has the disadvantage that the quantity of adhesive to be applied is very difficult or even impossible to accurately dispense a desired quantity because the user has to apply a very precise pressure to the pack.

Tube-like adhesive packages of soft metal are also known. In this case, the adhesive flows out when pressure is applied to the tube, a significant disadvantage being that the tube-like pack remains in its pressed-in position after the application of pressure and, in particular, after progressive emptying which makes the pack difficult to handle, particularly when it is no longer completely full. The stability of the pack is also adversely affected. In addition, the same problem occurs with known plastic bottle packs as with tube-like metal packages, which do not provide for precision dispensing.

The problem addressed by the present invention is to provide a dimensionally stable package with which the associated product can be dispensed in exact amounts, and which provide convenient handling irrespective of the level of fluid in the package.

3.0 Summary of the Invention

With the problems of the prior art in mind, in one embodiment of the invention, the container accommodating the product is formed by a flow-pressed tube-like aluminum container provided with a wall surface portion which can be pressed in on external application of pressure, but which returns to its normal position on removal of the pressure applied.

The inventive embodiment provides a dimensionally stable package which, at the same time, also provides for precision dispensing on application of external pressure. It has been discovered that, after flow pressing, aluminum containers of the invention are very hard and can be deformed to a certain extent but completely recover thereafter. Since the deformation applied from outside is limited to the normal pressure applied by the hand of the user, only a small quantity of product at a time can flow out, thereby permitting precision dispensing. Since, in addition, the compressed wall surface returns to its non-deformed or rest position after removal of the pressure due to its resilience and the minimal deformation applied, the package is dimensionally stable irrespective of its filling level. In addition, the package is highly impervious and, more particularly, watertight making it particularly suitable for fluid adhesives, particularly cyanoacrylate.

In a preferred embodiment of the invention, the container accommodating the product is circular in cross-section and has at least one compressible gripping recess in the wall surface. Such a circular flow-pressed aluminum container is almost completely dimensionally stable and cannot readily be compressed. The compressibility required for dispensing is provided by the at least one impressed gripping recess.

In one alternative embodiment, the container accommodating the product comprises two opposite gripping recesses. This considerably simplifies handling because the container can be gripped by the hand of the user and compressed by pressure simultaneously applied to both sides for dispensing the product.

In another alternative embodiment, the container accommodating the product has an oval cross-section. An oval flow-pressed aluminum profile combines dimensional stability with sufficient strength and, through its high resilience, enables the two opposite elongate wall regions to be readily compressed.

In another advantageous embodiment, a closeable dispensing nozzle of the product container consists of aluminum or polyethylene and, in known manner, can be made to taper to a point towards its outlet end. The closure may be formed, for example, by a plastic cap formed with a screwthread so that it may be screwed on. The pack is thus provided with a safe and tight closure.

BRIEF DESCRIPTION OF THE DRAWINGS

Various embodiments of the invention are described in detail below with reference to the accompanying drawings, in like items are identified by the same reference designations, wherein.

DETAILED DESCRIPTION OF THE INVENTION

Figure 1:
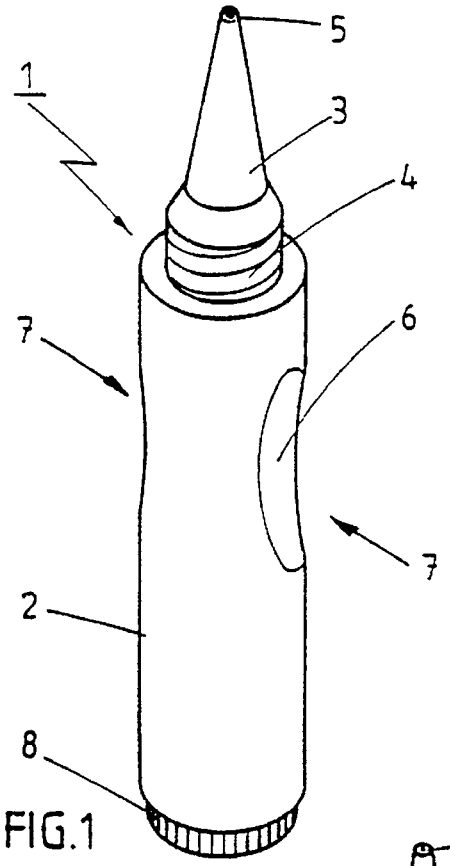
FIG. 1 is a perspective view of one embodiment of the pack according to the invention.

Referring to the drawings, a package for fluid products, particularly fluid adhesives, is globally denoted by the reference 1.

This package comprises a container 2 for accommodating the product which, at its upper end, is provided with an outlet opening not shown in the drawing. The outlet opening may be closed by a membrane which has to be pierced before the pack is used for the first time to dispense product. In the vicinity of the outlet opening, a closeable dispensing nozzle 3 is fixed to the product container 2, being provided for example with an external screwthread 4 for screwing on a closure cap (not shown) and tapering to a point towards the free outlet end 5.

According to the invention, the product container 2 is formed by a flow-pressed tube-like aluminum container. A container such as this is very hard after flow-pressing and can be deformed to a certain extent, recovering completely thereafter. However, since the circular cross-sectional form has very high dimensional stability, and allows slight deformation for the application of product, two opposite gripping recesses 6 are impressed in the wall surface of the product container 2. By applying pressure to these gripping recesses 6 in the direction of the arrows 7, the product container 2 can readily be compressed so that fluid product flows out through the dispensing nozzle 3 in a small and hence exact amount. After removal of the pressure, the gripping recesses 6 return to their starting position through the resilience of the aluminum container.

Accordingly, the limited deformability of the container 2 provides for a dimensionally stable package which, at the same time, provides for precision dispensing because only small amounts of product can flow out whenever pressure is applied. At the same time, the dimensional stability of the package ensures that this precision dispensing is possible irrespective of the filling level of the pack.

The dispensing nozzle 3 preferably consists of aluminum or a rigid polyethylene. The closure cap (not shown) may also consist, for example, of polyethylene. Accordingly, the package is stable and impervious, and may even be used for water-sensitive adhesives, for example for cyanoacrylate and solvent-containing products.

A sealingly insertable stopper 8, for example of polyethylene or any other suitable material, is provided in the bottom of the product container 2. The stopper 8 is removed to permit the container to be filled with the fluid product.

Figure 3:
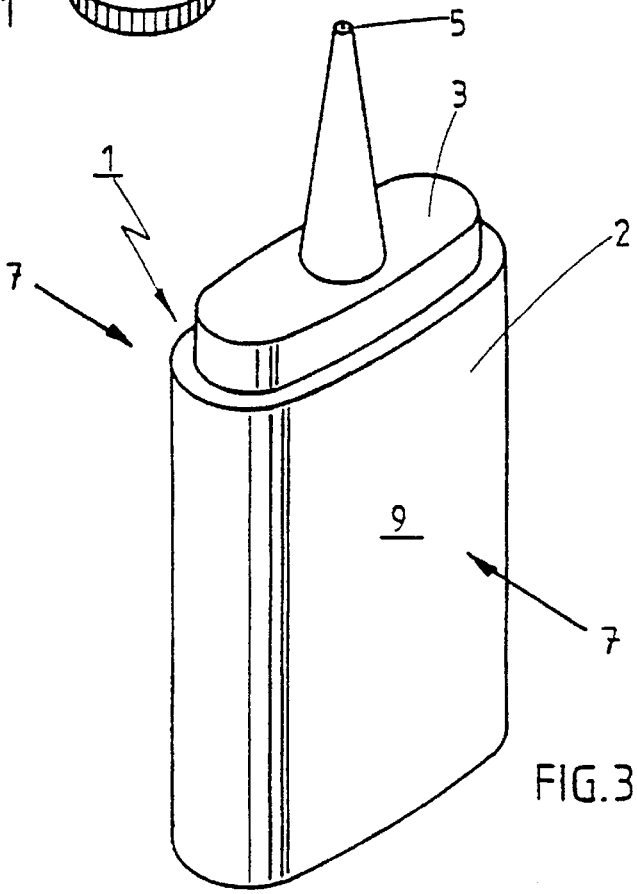
FIG. 3 is a perspective view of another embodiment of the pack according to the invention.

FIG. 3 shows another embodiment of the pack according to the invention, the same parts as in FIG. 1 being denoted by the same reference numerals.

Figure 2:
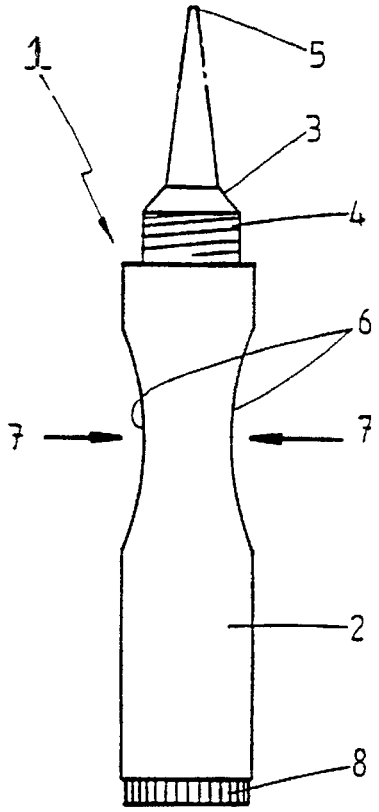
FIG. 2 is a side elevation of the pack shown in FIG. 1.

In this embodiment, the pack 1 comprises a product container 2 of aluminum which is oval in cross-section. The oval cross-section eliminates the need for the impressed gripping recesses present in the embodiment shown in FIGS. 1 and 2. When pressure is applied to the elongate wall regions denoted by the reference 9, adequate compression of the container is provided by application of pressure which, though light, is still sufficient for simple handling. The corresponding wall regions return to their starting or non-deformed rest position on removal of the pressure applied thereto.

The invention is not meant to be limited to the illustrated embodiments. Further modification of the invention is possible without departing from the basic concept. Thus, the cross-section of the product container may assume different shapes providing it is guaranteed that, on external application of pressure, the wall surface affected is only slightly pressed in and returns fully to its starting position on removal of the pressure applied. Such modifications are meant to be covered by the spirit and scope of the appended claims.

What is claimed is:

1. A package for flowable products comprising a container for holding a flowable product and a closeable dispensing nozzle fixed in the region of an outlet opening of the container, the container being provided with means operable for dispensing a substantially exact amount of product with each cycle of operation, including at least one wall surface which can be pressed in on external application of pressure to dispense said substantially exact amount of product, but which returns to its normal position on removal of the pressure applied, wherein said container is formed from extruded tube-like aluminum material and has circular cross-section, with at least one compressible gripping recess being formed in the material of said cylindrical wall surface, and a stopper being sealingly inserted into an access opening in a bottom surface of said container.

2. A package as claimed in claim 1, wherein the product container further comprises two opposing convex gripping recesses each formed in the material of said cylindrical wall surface.

3. A pack as claimed in claim 1, wherein the closeable dispensing nozzle of the container consists of aluminum.

4. A package as claimed in claim 1, wherein the closeable dispensing nozzle of said container consists of polyethylene.

5. A package as claimed in claim 2, wherein the closeable dispensing nozzle of said container consists of aluminum.

6. A package as claimed in claim 2, wherein the closeable dispensing nozzle of said container consists of polyethylene.

7. A package as claimed in claim 1, wherein said stopper consists of polyethylene.

8. A watertight package for fluid products comprising:

a container formed from a single piece of extruded aluminum material for holding a fluid product, said container having opposing sidewalls, a top, a bottom, an outlet opening in the top, and a filling opening in the bottom;

a closeable dispensing nozzle adapted for rigid attachment to said outlet opening of said container;

a removable stopper sealingly inserted into said filling opening;

at least a portion of the material of said opposing sidewalls being resilient with memory for a rest position, and can be pressed in or depressed by an external application of force, and which returns to its rest position upon the removal of the force, whereby each cycle of depression thereof provides for dispensing a substantially exact amount of fluid from said nozzle.

9. The package of claim 8, wherein said container consists of aluminum, and said compressible sidewall portion is formed by a compressible recess.

10. The package of claim 8, wherein said container is formed from a flow-pressed tube of aluminum, and at least one said compressible sidewall portion is provided as a recessed area in the sidewall.

11. The package of claim 10, wherein said container has a circular cross-section.

12. The package of claim 10, further including two opposing compressible sidewall portions in opposing recessed areas of said opposing sidewalls, respectively.

13. The package of claim 8, wherein said container has an oval cross-section.

14. The package of claim 8, further including two opposing compressible sidewall portions formed in recessed areas of said opposing sidewalls, respectively.

15. The package of claim 13, further including two opposing compressible sidewall portions formed in recessed areas of said opposing sidewalls, respectively.

16. The package of claim 8, wherein said closeable dispensing nozzle consists of polyethylene.

17. The package of claim 8 wherein said closeable dispensing nozzle consists of aluminum.

18. The package of claim 8, wherein said stopper consists of polyethylene.

* * * * *